United States Patent [19]

Mikula

[11] Patent Number: 4,773,577

[45] Date of Patent: Sep. 27, 1988

[54] FIRE FIGHTER'S AXE SLING

[76] Inventor: Patrick D. Mikula, 215 W. Front St., Erie, Pa. 16507

[21] Appl. No.: 31,879

[22] Filed: Mar. 30, 1987

Related U.S. Application Data

[63] Continuation-in-part of Ser. No. 823,186, Jan. 26, 1986, abandoned.

[51] Int. Cl.[4] ..... A45F 3/02

[52] U.S. Cl. ..... 224/202; 224/904; 224/234

[58] Field of Search ..... 30/296 R, 296 A, 308.1; 224/150, 202, 205, 206, 208, 257, 234, 919, 914

[56] References Cited

U.S. PATENT DOCUMENTS

| | | |
|---|---|---|
| 2,915,233 | 12/1959 | Moomaw . |
| 3,229,663 | 10/1966 | Torres . |
| 3,814,288 | 6/1974 | Westrich . |
| 4,085,872 | 4/1978 | Foo . |
| 4,088,251 | 5/1978 | Rodriguez . |
| 4,336,899 | 6/1982 | Price, II . |
| 4,541,540 | 9/1985 | Gretz et al. . |

*Primary Examiner*—Henry J. Recla
*Assistant Examiner*—Robert Petrik
*Attorney, Agent, or Firm*—Charles L. Lovercheck; Wayne L. Lovercheck; Dale R. Lovercheck

[57] ABSTRACT

A fire fighter's axe and sling combination is disclosed. The sling is attached to the wooden axe handle by two bands wrapped tightly around the handle at two spaced positions. It has been observed that fire fighter's axes are habitually exposed to abuse and rough treatment because of the emergency conditions which prevail during their use of the axe. The handles frequently break along lines disposed about 10 to 20 degrees to the longitudinal axis of the handle at the usual location of fracture. The bands pass around the handle at a position to reinforce the handle. A slot for receiving the sling is disposed adjacent the ends of the handle so that the sling will not interfere with the use of the axe and the firefighter can grasp the handle with the sling in the slot with no inconvenience.

5 Claims, 1 Drawing Sheet

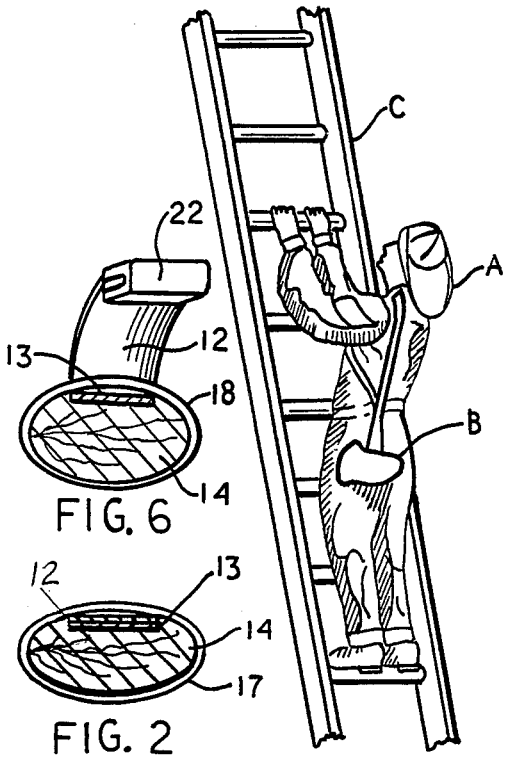
FIG. 6
FIG. 2
FIG. 1
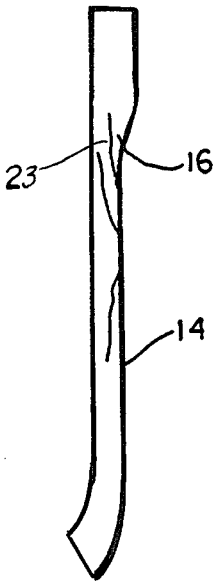
FIG. 3
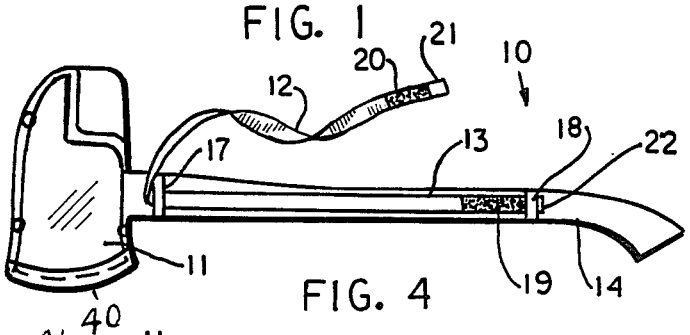
FIG. 4
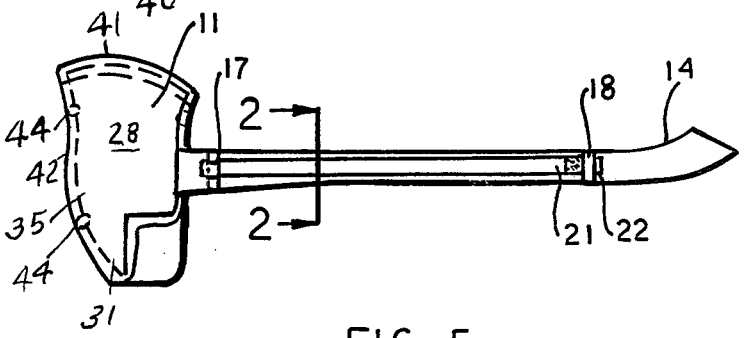
FIG. 5

FIRE FIGHTER'S AXE SLING

REFERENCE TO PRIOR APPLICATIONS

This application is a continuation-in-part of U.S. patent application Ser. No. 823,186, filed Jan. 26, 1986, now abandoned.

STATEMENT OF THE INVENTION

It is inconvenient for fire fighters and other persons who must carry axes while they climb ladders to use one hand in carrying the axe. Carrying such axes is dangerous because holding the axe in one hand leaves a single hand for the fire fighter to use to hold himself on the ladder. Moreover, the fire fighter may need to use one hand to carry other articles and to do other tasks such as carrying a hose or other tool.

An axe is the firefighter's most important tool. Firefighters' axes usually have wooden handles and the firefighters' axe is of necessity subjected to rough use and abuse. Consequently, broken handles are quite common. The characteristic axe handle breaks at an acute angle to the longitudinal axis of the handle. I have discovered that a band around the hangle near the axe head will add sufficient strength to the handle and at the same time, the band can be used to support a sling to carry the axe. A slot can be formed in the handle so that the sling will not interfere with the use of the axe.

The slings that have been proposed do not provide lightweight, convenient and economical devices. Furthermore, such prior art slings do not provide convenience in storing the sling when not in use.

BACKGROUND OF INVENTION

Many attempts have been made to provide a convenient, efficient and economical sling for fire fighter's axes. The following patents are examples of such efforts:

U.S. Pat. No. 2,915,233 to Moomaw
U.S. Pat. No. 3,279,663 to Torres
U.S. Pat. No. 3,814,288 to Westrich
U.S. Pat. No. 4,085,872 to Foo
U.S. Pat. No. 4,088,251 to Rodriguez
U.S. Pat. No. 4,336,899 to Price, II
U.S. Pat. No. 4,541,540 to Gretz et al.

None of these patents show slings for fire fighter's axes that are easy to use, economical to manufacture and have the several advantages that Applicant's sling has.

OBJECTS OF THE INVENTION

It is an object of the invention to provide an improved fire fighter's axe sling.

Another object of the invention is to provide a fire fighter's axe sling that will not interfere with the use of the axe.

Another object of the invention is to provide an axe sling that reinforces the axe handle.

Another object of the invention is to provide a. fire fighter's axe sling that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWINGS

FIG. 1 shows an isometric view of a fire fighter carrying an axe up a ladder with the sling according to the present invention.

FIG. 2 is a cross sectional view taken on line 2—2 of FIG. 5.

FIG. 3 is a side view of a firefighter's axe handle with a typical break pattern resulting from the ordinary abuse given a firefighter's axe in service.

FIG. 4 is a side view of an axe with a sling according to the invention showing one end of the sling free.

FIG. 5 is another side view of an axe, as shown in FIG. 4, with the sling in place as for use.

DETAILED DESCRIPTION OF THE DRAWINGS

Now with more particular reference to the drawing, I show a preferred embodiment of the invention is shown wherein a firefighter A is shown climbing a ladder C with an axe B. As shown in FIG. 1, an axe and sling combination 10 is carried by/includes a sling 12. The axe and handle are of the conventional type axe and handle commonly used by firefighters. The axe and handle combination 10 is one of the most important tools of the firefighter. The handle 14 is similar to the ordinary axe handle used by firefighters except that it has a longitudinal slot 13 cut in one side of the handle 14 which extends from a position adjacent the axe head 11 to a position adjacent the opposite end of the handle. The slot 13 may be, for example, $\frac{3}{4}$ inch wide and $\frac{1}{8}$ inch deep, depending on the dimensions of the sling strap. The slot 13 has a width slightly greater than the width of the sling 12 and slightly greater than twice the thickness of the sling 12, so that the sling 12 can snuggly fit in the slot 13 when the sling 12 is in the stored position and when the firefighter is using the axe, as shown in FIG. 5.

Handles of firefighters' axes are conventionally made of wood with a grain structure along which the handle fails when the axe is abused, as when it is used to pry something open, which is frequently done. The axe handle 14 may be subjected to stresses that will cause the handle to break along the grain of the wood. The grain of the wood is indicated at 16 on handle 14 in FIG. 3. Figure 3 shows a handle that has broken along the grain 16 in a manner in which the handle 14 frequently breaks.

Bands 17 and 18 will hold the wood along the grain together to avoid breakage along the grain and adds substantial strength to the axe handle 14, in addition to providing an anchor point for the sling 12. The bands 17 and 18 may be made of stainless steel or other metallic materials or they could be made of linen thread wrapped tightly around the handle. The band 17 is located adjacent the axe head 11. The band 18 is located adjacent the opposite end of the handle from the axe head.

The sling may be made of nylon web, for example, and have a thickness half the thickness of the slot 13. The sling 12 has a length approximately twice the length of the slot 13 and a width approximately equal to the width of the slot 13. The sling 12 has enlarged parts which act as stops 21 and 22 on each end. The enlarged stops 21 and 22 are thicker than the distance from the band 17 and the band 18 to the bottom of the slot so that the enlarged stops 21 and 22 allow the sling to slide under the band and the stops engage the band. The sling 12 has Velcro material 19 and 20 adjacent its ends which can be placed together to hold the sling in the stored position, as shown in FIG. 5, when the axe is being used.

When the firefighter desires to climb a ladder, he will manually grasp the end of the sling 12 adjacent the stop 21 to separate the Velcro parts 19 and 21. He will then lift the bottom layer of the sling from the slot 13 so that the stop 21/22 slides into engagement with the band 17. He will then place his arm under the sling, putting the sling over his shoulder in the position shown in FIG. 1, so that he can carry the axe and yet use both of his hands to hold onto the ladder C. When the firefighter reaches the top of the ladder, he can pull the stop 21 to the position shown in FIG. 5 and connect the Velcro material 19 to the Velcro material 20. This takes only seconds of time. The two parts of the sling will then be supported in the slot 13 in a position as shown in FIG. 2 and FIG. 5.

The length of the sling can be adjusted by means of the Velcro to accommodate different size persons, in a manner familiar to those skilled in the art. The sling can be drawn up tight so that when the Velcro 19 is affixed to the Velcro 20, the sling 12 will be disposed in the slot 13 where it will be out of the way for using the axe.

The shield 35 is shaped to conform to one side of the axe head 11. The axe head 11 will be placed in the shield 35 and resilient buttons 44 made of plastic or a thin metal clip or other suitable material, which will snap around the axe head 11, including the point 31 on the axehead 11, to hold the shield 35 in place. The shield 35 not only protects the body of the firefighter while carrying the axe by means of the sling 12, but the shield 35 also protects surrounding articles and persons that may come into contact with the axe. The shield 35 will be made of a non-metallic material such as a plastic which is electrically non-conductive which adds an additional protective feature to the device.

The shield 35 has a flat bottom 28 conforming to one side of the axe head 11 and upwardly extending side 43. Buttons 44 on one side of the shield 35 are open and the side 43 is closed. The channel 40 is formed for receiving the sharp edge of the axe head 11. Edge flanges 41 and 42 extend upward from side 43 and hold the axe head in place. The buttons 44 retain the axe head in the shield. The axe head 11 will have a characteristic shape of firefighters' axes such as for example, an axe having a point 31 on it, which is characteristic of firefighters' axes.

The foregoing specification sets forth the invention in its preferred, practical forms but the structure shown in capable of modification within a range of equivalents without departing from the invention which is to be understood is broadly novel as is commensurate with the appended claims.

The embodiments of the invention in which an exclusive property or privilege is claimed are defined as follows:

1. In combination, a sling, an axe head and a wooden handle adapted to split upon abusive use, said handle having a first end and a second end, said axe head being fixed to said first end of said handle, a longitudinally extending slot having a first end and a second end formed in said handle and terminating adjacent said second end of said handle, a first band disposed around said handle and engaging said handle and overlying said first end of said slot, a second band disposed around said handle adjacent said second end thereof and overlying said second end of said slot, said sling having a first end and a second end, said first end of said sling being disposed in said slot and extending under said first band resting in said slot and extending under said second band, said sling having an enlarged stop, a first piece of Velcro material on said first end of said sling and a second piece of Velcro material on said second end of said sling whereby said first end of said sling is held to said second end of said sling, said sling having a first stop means on said first end of said sling and a second stop means on said second end of said sling preventing said sling from being pulled under said bands, said Velcro material being adapted to be separated and said second end of said sling being pulled bringing said second stop means into engagement with said second band whereby a portion between said first end of said sling and said second end of said sling may be placed over the shoulder of a firefighter for carrying said axe by said sling.

2. The combination recited in claim 1 wherein said first stop means comprises an enlarged end on said first end of said sling.

3. The combination recited in claim 1, wherein said second stop means comprises an enlarged end on said second end of said sling.

4. The combination recited in claim 1 wherein the depth of said slot is approximately twice the thickness of said sling.

5. The combination recited in claim 1 wherein a shield is provided to receive said axe head, said shield having an open side to receive said axe head and a closure for said open side and fasteners to hold said closure closed.

* * * * *